US010132056B2

(12) United States Patent
Tsukamoto

(10) Patent No.: US 10,132,056 B2
(45) Date of Patent: Nov. 20, 2018

(54) SHOVEL

(71) Applicant: SUMITOMO(S.H.I.) CONSTRUCTION MACHINERY CO., LTD., Tokyo (JP)

(72) Inventor: Hiroyuki Tsukamoto, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 160 days.

(21) Appl. No.: 15/200,196

(22) Filed: Jul. 1, 2016

(65) Prior Publication Data

US 2016/0312441 A1 Oct. 27, 2016

Related U.S. Application Data

(63) Continuation of application No. 14/742,877, filed on Jun. 18, 2015, now Pat. No. 9,382,687, which is a (Continued)

(30) Foreign Application Priority Data

Dec. 21, 2012 (JP) ..... 2012-279896

(51) Int. Cl.
*E02F 9/22* (2006.01)
*E02F 3/43* (2006.01)
(Continued)

(52) U.S. Cl.
CPC ..... *E02F 9/2214* (2013.01); *E02F 3/32* (2013.01); *E02F 3/435* (2013.01); *E02F 9/2203* (2013.01);
(Continued)

(58) Field of Classification Search
CPC combination set(s) only.
See application file for complete search history.

(56) References Cited

U.S. PATENT DOCUMENTS 4,896,582 A 1/1990 Tordenmalm et al.
6,047,228 A 4/2000 Stone et al.
(Continued)

FOREIGN PATENT DOCUMENTS

EP 1127986 A1 8/2001
JP S50-139410 U 11/1975
(Continued)

OTHER PUBLICATIONS

International Search Report dated Dec. 17, 2013.

*Primary Examiner* — Redhwan K Mawari
(74) *Attorney, Agent, or Firm* — IPUSA, PLLC

(57) ABSTRACT

A shovel that performs excavation in accordance with an arm excavation operation including an arm closing operation includes an excavation operation detection part, a position detection part, a maximum allowable pressure calculation part, and an arm cylinder pressure control part. The excavation operation detection part detects that the arm excavation operation has been performed. The position detection part detects the position of the shovel. The maximum allowable pressure calculation part calculates the pressure of the expansion-side oil chamber of an arm cylinder corresponding to an excavation reaction force at a time when the shovel is dragged by the excavation reaction force as a maximum allowable pressure, based on the position of the shovel. The arm cylinder pressure control part controls the pressure of the expansion-side oil chamber not to exceed the maximum allowable pressure when the arm excavation operation is performed.

11 Claims, 7 Drawing Sheets

Related U.S. Application Data continuation of application No. PCT/JP2013/074285, filed on Sep. 9, 2013.

(51) Int. Cl.
*E02F 9/26* (2006.01)
*E02F 3/32* (2006.01)

(52) U.S. Cl.
CPC ..... *E02F 9/226* (2013.01); *E02F 9/2285* (2013.01); *E02F 9/2292* (2013.01); *E02F 9/264* (2013.01); *E02F 9/265* (2013.01)

(56) References Cited

U.S. PATENT DOCUMENTS

| | | | | |
|---|---|---|---|---|
| 6,257,118 | B1 | 7/2001 | Wilbur et al. | |
| 8,930,090 | B2 | 1/2015 | Okamura et al. | |
| 8,972,122 | B2 | 3/2015 | Magaki et al. | |
| 9,204,626 | B2 | 12/2015 | Vitali et al. | |
| 2004/0098984 | A1 | 5/2004 | Duell | |
| 2008/0142232 | A1 | 6/2008 | Palmer et al. | |
| 2010/0034630 | A1 | 2/2010 | Kobata | |
| 2011/0056099 | A1* | 3/2011 | Paull ..... | E02F 3/404 37/348 |
| 2011/0318157 | A1 | 12/2011 | Okamura et al. | |
| 2012/0057956 | A1 | 3/2012 | Shirao et al. | |
| 2012/0082536 | A1 | 4/2012 | Kawashima et al. | |
| 2012/0089288 | A1 | 4/2012 | Kawashima | |
| 2012/0246981 | A1* | 10/2012 | Magaki ..... | E02F 9/2075 37/443 |
| 2012/0274121 | A1 | 11/2012 | Minoshima et al. | |
| 2012/0315119 | A1* | 12/2012 | Magaki ..... | B60W 20/00 414/685 |
| 2013/0073151 | A1* | 3/2013 | Wada ..... | E02F 3/434 701/50 |
| 2013/0345939 | A1* | 12/2013 | Magaki ..... | E02F 9/2214 701/50 |

FOREIGN PATENT DOCUMENTS

| | | |
|---|---|---|
| JP | S51-078506 | 7/1976 |
| JP | S54-004402 | 1/1979 |
| JP | S62-086234 | 4/1987 |
| JP | S64-006420 | 1/1989 |
| JP | H05-321296 | 12/1993 |
| JP | H07-020353 U | 4/1995 |
| JP | H08-333769 | 12/1996 |
| JP | H11-324002 | 11/1999 |
| JP | 2003-105795 | 4/2003 |
| JP | 2008-169640 | 7/2008 |
| JP | 2010-106487 | 5/2010 |
| WO | 2010/101233 | 9/2010 |
| WO | 2012/121253 | 9/2012 |

* cited by examiner

SHOVEL

CROSS-REFERENCE TO RELATED APPLICATIONS

The present application is a continuation of U.S. patent application Ser. No. 14/742,877, filed on Jun. 18, 2015, which is a continuation application filed under 35 U.S.C. 111(a) claiming benefit under 35 U.S.C. 120 and 365(c) of PCT International Application No. PCT/JP2013/074285, filed on Sep. 9, 2013 and designating the U.S., which claims priority to Japanese Patent Application No. 2012-279896, filed on Dec. 21, 2012. The disclosures of the prior applications are hereby incorporated herein in their entirety by reference.

BACKGROUND

Technical Field

The present invention relates to a shovel that includes an excavation attachment moved by a hydraulic cylinder, and to a method of controlling the shovel.

Description of Related Art

An overload prevention device for hydraulic power shovels has been known.

This overload prevention device prevents, during excavation work of a power shovel, a lift of front wheels by detecting a reaction force from the ground as a holding hydraulic pressure in the head-side oil chamber of a boom cylinder and opening a relief valve when the holding hydraulic pressure reaches a predetermined pressure.

Furthermore, the lift of front wheels is prevented by automatically causing a boom, an arm and a bucket to operate by putting a boom main operation valve, an arm main operation valve, and a bucket main operation valve into operation, instead of opening the relief valve.

SUMMARY

According to an embodiment of the present invention, a shovel that performs excavation in accordance with an arm excavation operation including an arm closing operation includes an excavation operation detection part, a position detection part, a maximum allowable pressure calculation part, and an arm cylinder pressure control part. The excavation operation detection part detects that the arm excavation operation has been performed. The position detection part detects the position of the shovel. The maximum allowable pressure calculation part calculates the pressure of the expansion-side oil chamber of an arm cylinder corresponding to an excavation reaction force at a time when the shovel is dragged by the excavation reaction force as a maximum allowable pressure, based on the position of the shovel. The arm cylinder pressure control part controls the pressure of the expansion-side oil chamber not to exceed the maximum allowable pressure when the arm excavation operation is performed.

According to an embodiment of the present invention, a method of controlling a shovel that performs excavation in accordance with an arm excavation operation including an arm closing operation includes detecting that the arm excavation operation has been performed, detecting the position of the shovel, calculating the pressure of the expansion-side oil chamber of an arm cylinder corresponding to an excavation reaction force at a time when the shovel is dragged by the excavation reaction force as a maximum allowable pressure, based on the position of the shovel, and controlling the pressure of the expansion-side oil chamber of the arm cylinder not to exceed the maximum allowable pressure when the arm excavation operation is performed.

DETAILED DESCRIPTION

The above-described overload prevention device, however, only prevents a lift of the body of the power shovel during excavation work, and cannot prevent the body of the shovel from being dragged toward the bucket during excavation work.

According to an aspect of the present invention, a shovel and a method of controlling a shovel that prevent the body of the shovel from being dragged during excavation work are provided.

A description is given, with reference to the drawings, of an embodiment of the present invention.

Figure 1:
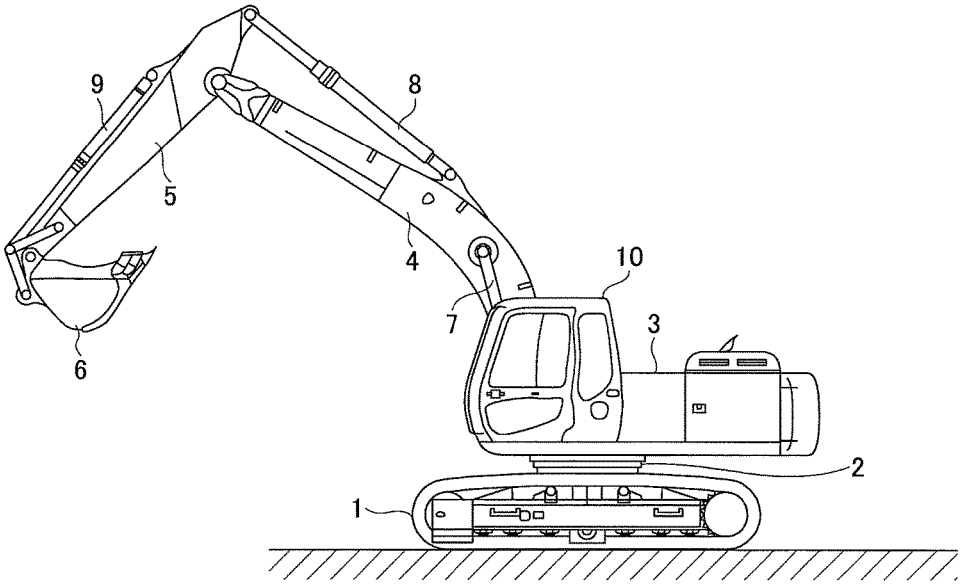
FIG. 1 is a side view of a shovel according to an embodiment of the present invention.

FIG. 1 is a side view illustrating a shovel according to this embodiment.

An upper-part turning body 3 is mounted on a lower-part traveling body 1 of the shovel via a turning mechanism 2. A boom 4 is attached to the upper-part turning body 3. An arm 5 is attached to the end of the boom 4. A bucket 6 is attached to the end of the arm 5. The boom 4, the arm 5, and the bucket 6 form an excavation attachment, and are hydraulically driven by a boom cylinder 7, an arm cylinder 8, and a bucket cylinder 9, respectively, which are hydraulic cylinders. A cabin 10 is provided on and power sources such as an engine are mounted in the upper-part turning body 3.

Figure 2:
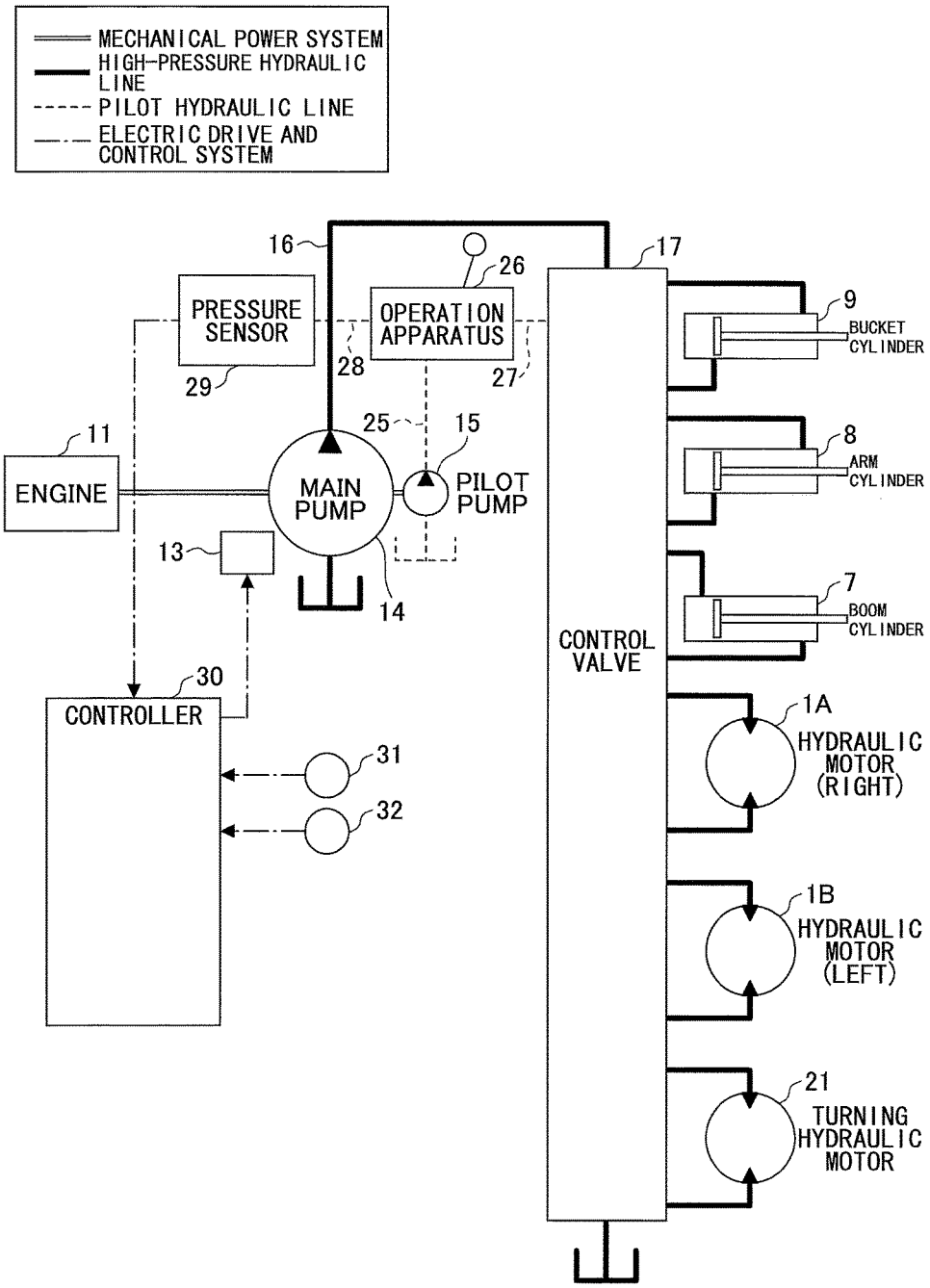
FIG. 2 is a block diagram illustrating a configuration of a drive system of the shovel of FIG. 1.

FIG. 2 is a block diagram illustrating a configuration of a drive system of the shovel of FIG. 1. In FIG. 2, a mechanical power system, a high-pressure hydraulic line, a pilot hydraulic line, and an electric drive and control system are indicated by a double line, a bold solid line, a broken line, and a one-dot chain line, respectively.

A main pump 14 and a pilot pump 15 as hydraulic pumps are connected to an output shaft of an engine 11 as a mechanical drive part. A control valve 17 is connected to the main pump 14 via a high-pressure hydraulic line 16. Furthermore, an operation apparatus 26 is connected to the pilot pump 15 via a pilot hydraulic line 25. Furthermore, the main pump 14 is a variable displacement hydraulic pump whose discharge flow rate per pump revolution is controlled by a regulator 13.

The control valve 17 is a device that controls the hydraulic system of the shovel. Hydraulic actuators such as hydraulic motors 1A (right) and 1B (left) for the lower-part traveling body 1, the boom cylinder 7, the arm cylinder 8, the bucket cylinder 9, and a turning hydraulic motor 21 are connected to the control valve 17 via high-pressure hydraulic lines.

The operation apparatus 26 is an apparatus for operating hydraulic actuators, and includes a lever and a pedal. The operation apparatus 26 is connected to the control valve 17 and a pressure sensor 29 via pilot hydraulic lines 27 and 28, respectively. The pressure sensor 29 is connected to a controller 30 that controls driving of an electrical system.

The controller 30 is a main control part that controls driving of the shovel. According to this embodiment, the controller 30 is a computer that includes a CPU (Central Processing Unit), a RAM (Random Access Memory), and a ROM (Read Only Memory). The controller 30, for example, reads programs corresponding to various kinds of control from the ROM, loads the programs into the RAM, and causes the CPU to execute processes corresponding to various kinds of control.

A pressure sensor 31 is a sensor that detects the pressure of hydraulic oil in the oil chambers of hydraulic cylinders, and outputs detected values to the controller 30.

A position sensor 32 is a sensor that detects the position of the shovel, and outputs a detected value to the controller 30.

Figure 3:
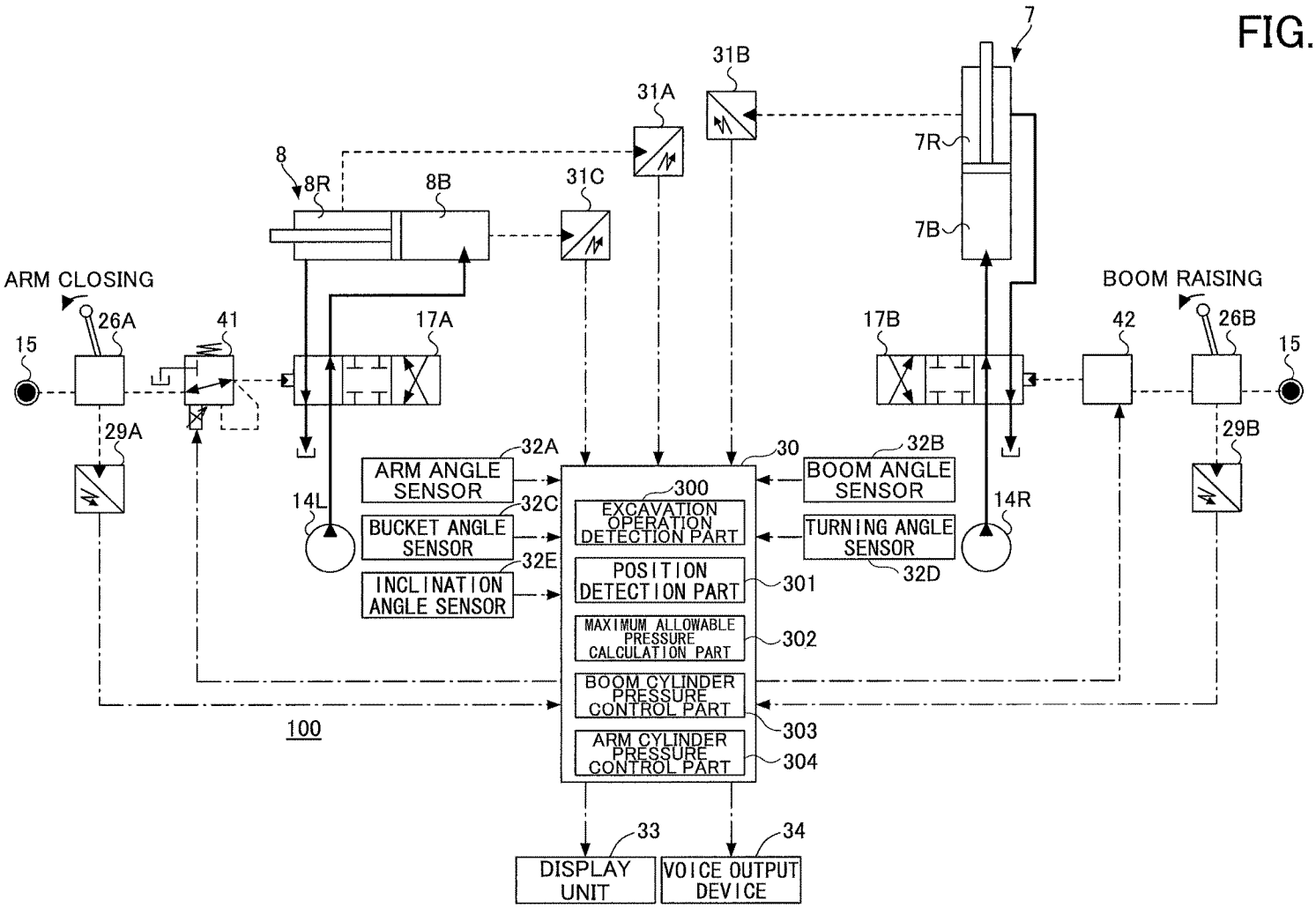
FIG. 3 is a schematic diagram illustrating a configuration of an excavation support system mounted in the shovel of FIG. 1.

FIG. 3 is a schematic diagram illustrating an excavation support system 100 mounted in the shovel of FIG. 1. Like in FIG. 2, a high-pressure hydraulic line, a pilot hydraulic line, and an electric drive and control system are indicated by a bold solid line, a broken line, and a one-dot chain line, respectively, in FIG. 3. Furthermore, FIG. 3 illustrates a state where a complex excavation operation including a boom raising operation and an arm closing operation is being performed.

The excavation support system 100 is a system that supports operations for excavation work using the shovel by an operator. According to this embodiment, the excavation support system 100 mainly includes pressure sensors 29A and 29B, the controller 30, pressure sensors 31A through 31C, position sensors 32A through 32E, a display unit 33, a voice output device 34, and electromagnetic proportional valves 41 and 42.

The pressure sensor 29A, which is an example of the pressure sensor 29, detects an operating state of an arm operation lever 26A, which is an example of the operation apparatus 26, and outputs a detection result to the controller 30.

The pressure sensor 29B, which is an example of the pressure sensor 29, detects an operating state of a boom operation lever 26B, which is an example of the operation apparatus 26, and outputs a detection result to the controller 30.

The pressure sensor 31A, which is an example of the pressure sensor 31, detects the pressure of hydraulic oil in a rod-side oil chamber 8R of the arm cylinder 8, and outputs a detection result to the controller 30. According to this embodiment, the rod-side oil chamber 8R corresponds to a contraction-side oil chamber at the time of closing of the arm 5.

The pressure sensor 31B, which is an example of the pressure sensor 31, detects the pressure of hydraulic oil in a rod-side oil chamber 7R of the boom cylinder 7, and outputs a detection result to the controller 30. According to this embodiment, the rod-side oil chamber 7R corresponds to a contraction-side oil chamber at the time of rising of the boom 4. Furthermore, a bottom-side oil chamber 7B of the boom cylinder 7 corresponds to an expansion-side oil chamber at the time of rising of the boom 4.

The pressure sensor 31C, which is an example of the pressure sensor 31, detects the pressure of hydraulic oil in a bottom-side oil chamber 8B of the arm cylinder 8, and outputs a detection result to the controller 30. According to this embodiment, the bottom-side oil chamber 8B corresponds to an expansion-side oil chamber at the time of closing of the arm 5.

The arm angle sensor 32A, which is an example of the positions sensor 32 and is, for example, a potentiometer, detects the opening and closing angle of the arm 5 relative to the boom 4 (hereinafter referred to as "arm angle"), and outputs a detection result to the controller 30.

The boom angle sensor 32B, which is an example of the position sensor 32 and is, for example, a potentiometer, detects the depression and elevation angle of the boom 4 relative to the upper-part turning body 3 (hereinafter referred to as "boom angle"), and outputs a detection result to the controller 30.

The bucket angle sensor 32C, which is an example of the positions sensor 32 and is, for example, a potentiometer, detects the opening and closing angle of the bucket 6 relative to the arm 5 (hereinafter referred to as "bucket angle"), and outputs a detection result to the controller 30.

The turning angle sensor 32D, which is an example of the position sensor 32, detects the turning angle of the upper-part turning body 3 relative to the lower-part traveling body 1, and outputs a detection result to the controller 30.

The inclination angle sensor 32E, which is an example of the position sensor 32, detects the angle of inclination of a ground contact surface of the shovel relative to a horizontal plane, and outputs a detection result to the controller 30.

The display unit 33 is a device for displaying various kinds of information, and is, for example, a liquid crystal display installed in the cab of the shovel. The display unit 33 displays various kinds of information on the excavation support system 100 in response to a control signal from the controller 30.

The voice output device 34 is a device for outputting various kinds of information by voice, and is, for example, a loudspeaker installed in the cab of the shovel. The voice output device 34 outputs various kinds of information on the excavation support system 100 by voice in accordance with a control signal from the controller 30.

The electromagnetic proportional valve 41 is a valve placed in a pilot hydraulic line between an arm selector valve 17A, which is an example of the control valve 17, and the arm operation lever 26A. The electromagnetic proportional valve 41 controls a pilot pressure applied to a pilot port for an arm closing operation in the arm selector valve 17A in accordance with a control current from the controller 30. According to this embodiment, the electromagnetic proportional valve 41 is configured so that a primary side pressure (a pilot pressure for an arm closing operation output by the arm operation lever 26A) and a secondary side pressure (a pilot pressure applied to the pilot port for an arm closing operation) are equal when receiving no control current. Furthermore, the electromagnetic proportional valve 41 is configured so that the secondary side pressure becomes less than the primary side pressure as the control current from the controller 30 increases.

The electromagnetic proportional valve 42 is a valve placed in a pilot hydraulic line between a boom selector valve 17B, which is an example of the control valve 17, and the boom operation lever 26B. The electromagnetic proportional valve 42 controls a pilot pressure applied to a pilot port for a boom raising operation in the boom selector valve 17B in accordance with a control current from the controller 30. According to this embodiment, the electromagnetic proportional valve 42 is configured so that a primary side pressure (a pilot pressure for a boom raising operation output by the boom operation lever 26B) and a secondary side pressure (a pilot pressure applied to the pilot port for a boom raising operation) are equal when receiving no control current. Furthermore, the electromagnetic proportional valve 42 is configured so that the secondary side pressure becomes greater than the primary side pressure as the control current from the controller 30 increases.

The controller 30 performs an operation with various kinds of functional elements by obtaining the outputs of the various sensors 29A, 29B, 31A through 31C and 32A through 32E. Then, the controller 30 outputs the operation result to the display unit 33, the voice output device 34, and the electromagnetic proportional valves 41 and 42.

The various kinds of functional elements include an excavation operation detection part 300, a position detection part 301, a maximum allowable pressure calculation part 302, a boom cylinder pressure control part 303, and an arm cylinder pressure control part 304.

The excavation operation detection part 300 is a functional element that detects that an excavation operation has been performed. According to this embodiment, the excavation operation detection part 300 detects whether a complex excavation operation including an arm closing operation and a boom raising operation has been performed. Specifically, the excavation operation detection part 300 detects that a complex excavation operation has been performed when a boom raising operation is detected, the pressure of the rod-side oil chamber 7R of the boom cylinder 7 is a predetermined value $\alpha$ or more, and a pressure difference obtained by subtracting the pressure of the rod-side oil chamber 8R from the pressure of the bottom-side oil chamber 8B of the arm cylinder 8 is a predetermined value $\beta$ or more. Furthermore, the excavation operation detection part 300 may detect that a complex excavation operation has been performed with detection of an arm closing operation serving as an additional condition. The excavation operation detection part 300 may detect whether a complex excavation operation has been performed using the outputs of other sensors such as the position sensor 32 in addition to or in place of the outputs of the pressure sensors 29A, 29B and 31A through 31C.

Furthermore, the excavation operation detection part 300 may detect whether an arm excavation operation including an arm closing operation has been performed. Specifically, the excavation operation detection part 300 detects that an arm excavation operation has been performed when an arm closing operation is detected, the pressure of the rod-side oil chamber 7R of the boom cylinder 7 is the predetermined value $\alpha$ or more, and a pressure difference obtained by subtracting the pressure of the rod-side oil chamber 8R from the pressure of the bottom-side oil chamber 8B of the arm cylinder 8 is the predetermined value $\beta$ or more. The arm excavation operation includes a simple operation of an arm closing operation only, a complex operation that is a combination of an arm closing operation and a boom rising operation or boom lowering operation, and a complex operation that is a combination of an arm closing operation and a bucket closing operation.

The position detection part 301 is a functional element that detects the position of the shovel. According to this embodiment, the position detection part 301 detects a boom angle, an arm angle, a bucket angle, an angle of inclination, and a turning angle as the position of the shovel. Specifically, the position detection part 301 detects a boom angle, an arm angle, and a bucket angle based on the outputs of the positions sensors 32A through 32C. Furthermore, the position detection part 301 detects a turning angle based on the output of the turning angle sensor 32D. Furthermore, the position detection part 301 detects an angle of inclination based on the output of the inclination angle sensor 32E. A detailed description is given below of detection of the position of the shovel by the position detection part 301.

The maximum allowable pressure calculation part 302 is a functional element that calculates maximum allowable pressures of hydraulic oil in various kinds of hydraulic cylinders that are required to be known in order to prevent an unintended movement of the body of the shovel during excavation work. According to this embodiment, the maximum allowable pressure calculation part 302 calculates the maximum allowable pressure of the rod-side oil chamber 7R of the boom cylinder 7 that is required to be known in order to prevent a lift of the body of the shovel during excavation work. In this case, the pressure of the rod-side oil chamber 7R of the boom cylinder 7 exceeding its maximum allowable pressure means that the body of the shovel can be lifted. Furthermore, the maximum allowable pressure calculation part 302 calculates the maximum allowable pressure of the bottom-side oil chamber 8B of the arm cylinder 8 that is required to be known in order to prevent the body of the shovel from being dragged toward an excavation point during excavation work. In this case, the pressure of the bottom-side oil chamber 8B of the arm cylinder 8 exceeding its maximum allowable pressure means that the body of the shovel can be dragged toward the excavation point. A detailed description is given below of calculation of a maximum allowable pressure by the maximum allowable pressure calculation part 302.

The boom cylinder pressure control part 303 is a functional element that controls the pressure of hydraulic oil in the boom cylinder 7 in order to prevent an unintended movement of the body of the shovel during excavation work. According to this embodiment, the boom cylinder pressure control part 303 controls the pressure of hydraulic oil in the rod-side oil chamber 7R of the boom cylinder 7 to be a maximum allowable pressure or less in order to prevent a lift of the body of the shovel. Specifically, when a complex excavation operation is being performed, the boom cylinder pressure control part 303 outputs a control current to the electromagnetic proportional valve 42 in response to the pressure of the rod-side oil chamber 7R increasing to reach a predetermined pressure that is less than or equal to a maximum allowable pressure. Then, the boom cylinder pressure control part 303 causes the secondary side pressure (pilot pressure applied to the pilot port for a boom raising operation) to be greater than the primary side pressure (pilot pressure for a boom raising operation output by the boom operation lever 26B) of the electromagnetic proportional valve 42. As a result, the flow rate of hydraulic oil flowing out from the rod-side oil chamber 7R to a tank increases, so that the pressure of the rod-side oil chamber 7R decreases. Furthermore, the rising speed of the boom 4 increases. In this manner, the boom cylinder pressure control part 303 prevents the pressure of the rod-side oil chamber 7R from exceeding a maximum allowable pressure by causing the pressure of the rod-side oil chamber 7R to be less than a predetermined pressure, so as to prevent a lift of the body of the shovel.

Furthermore, when having output a control current to the electromagnetic proportional valve 42, the boom cylinder pressure control part 303 outputs a control signal to at least one of the display unit 33 and the voice output device 34.

Then, the boom cylinder pressure control part 303 causes a text message to the effect that the pilot pressure applied to the pilot port for a boom raising operation has been automatically adjusted to be displayed on the display unit 33. Furthermore, the boom cylinder pressure control part 303 causes a voice message to that effect or alarm sound to be output from the voice output device 34 by voice. This is to inform an operator that the boom raising operation using the boom operation lever 26B by the operator has been adjusted.

The arm cylinder pressure control part 304 is a functional element that controls the pressure of hydraulic oil in the arm cylinder 8 in order to prevent an unintended movement of the body of the shovel during excavation work. According to this embodiment, the arm cylinder pressure control part 304 controls the pressure of hydraulic oil in the bottom-side oil chamber 8B of the arm cylinder 8 to be a maximum allowable pressure or less in order to prevent a lift of the body of the shovel. Specifically, when a complex excavation operation is being performed, the arm cylinder pressure control part 304 outputs a control current to the electromagnetic proportional valve 41 in response to the pressure of the bottom-side oil chamber 8B increasing to reach a predetermined pressure that is less than or equal to a maximum allowable pressure. Then, the arm cylinder pressure control part 304 causes the secondary side pressure (pilot pressure applied to the pilot port for an arm closing operation) to be less than the primary side pressure (pilot pressure for an arm closing operation output by the arm operation lever 26A) of the electromagnetic proportional valve 41. As a result, the flow rate of hydraulic oil flowing out from a main pump 14L to the bottom-side oil chamber 8R decreases, so that the pressure of the bottom-side oil chamber 8B decreases. Furthermore, the closing speed of the arm 5 decreases. In this manner, the arm cylinder pressure control part 304 prevents the pressure of the bottom-side oil chamber 8B from exceeding a maximum allowable pressure by causing the pressure of the bottom-side oil chamber 8R to be less than a predetermined pressure, so as to prevent a lift of the body of the shovel. Furthermore, the arm cylinder pressure control part 304 may reduce the secondary side pressure of the electromagnetic proportional valve 41 until the flow rate of hydraulic oil flowing from the main pump 14L into the bottom-side oil chamber 8B becomes zero as required. That is, the operation of closing the arm 5 may be stopped even when an arm closing operation is being performed by the operator. This is to ensure prevention of a lift of the body of the shovel.

Furthermore, the arm cylinder pressure control part 304 controls the pressure of hydraulic oil in the bottom-side oil chamber 8 of the arm cylinder 8 to be a maximum allowable pressure or less in order to prevent the body of the shovel from being dragged toward an excavation point. Specifically, when arm excavation work is being performed, the arm cylinder pressure control part 304 outputs a control current to the electromagnetic proportional valve 41 in response to the pressure of the bottom-side oil chamber 8B increasing to reach a predetermined pressure that is less than or equal to a maximum allowable pressure. As a result, the flow rate of hydraulic oil flowing out from the main pump 14L to the bottom-side oil chamber 8R decreases, so that the pressure of the bottom-side oil chamber 8B decreases. Furthermore, the closing speed of the arm 5 decreases. In this manner, the arm cylinder pressure control part 304 prevents the pressure of the bottom-side oil chamber 8B from exceeding a maximum allowable pressure by causing the pressure of the bottom-side oil chamber 8R to be less than a predetermined pressure, so as to prevent the body of the shovel from being dragged toward an excavation point. Furthermore, the arm cylinder pressure control part 304 may reduce the secondary side pressure of the electromagnetic proportional valve 41 until the flow rate of hydraulic oil flowing from the main pump 14L into the bottom-side oil chamber 8B becomes zero as required. That is, the operation of closing the arm 5 may be stopped even when an arm closing operation is being performed by the operator. This is to ensure that the body of the shovel is prevented from being dragged toward an excavation point.

Furthermore, like the boom cylinder pressure control part 303, the arm cylinder pressure control part 304 outputs a control signal to at least one of the display unit 33 and the voice output device 34 when having output a control current to the electromagnetic proportional valve 41. This is to inform an operator that the arm closing operation using the arm operation lever 26A by the operator has been adjusted.

Figure 4:
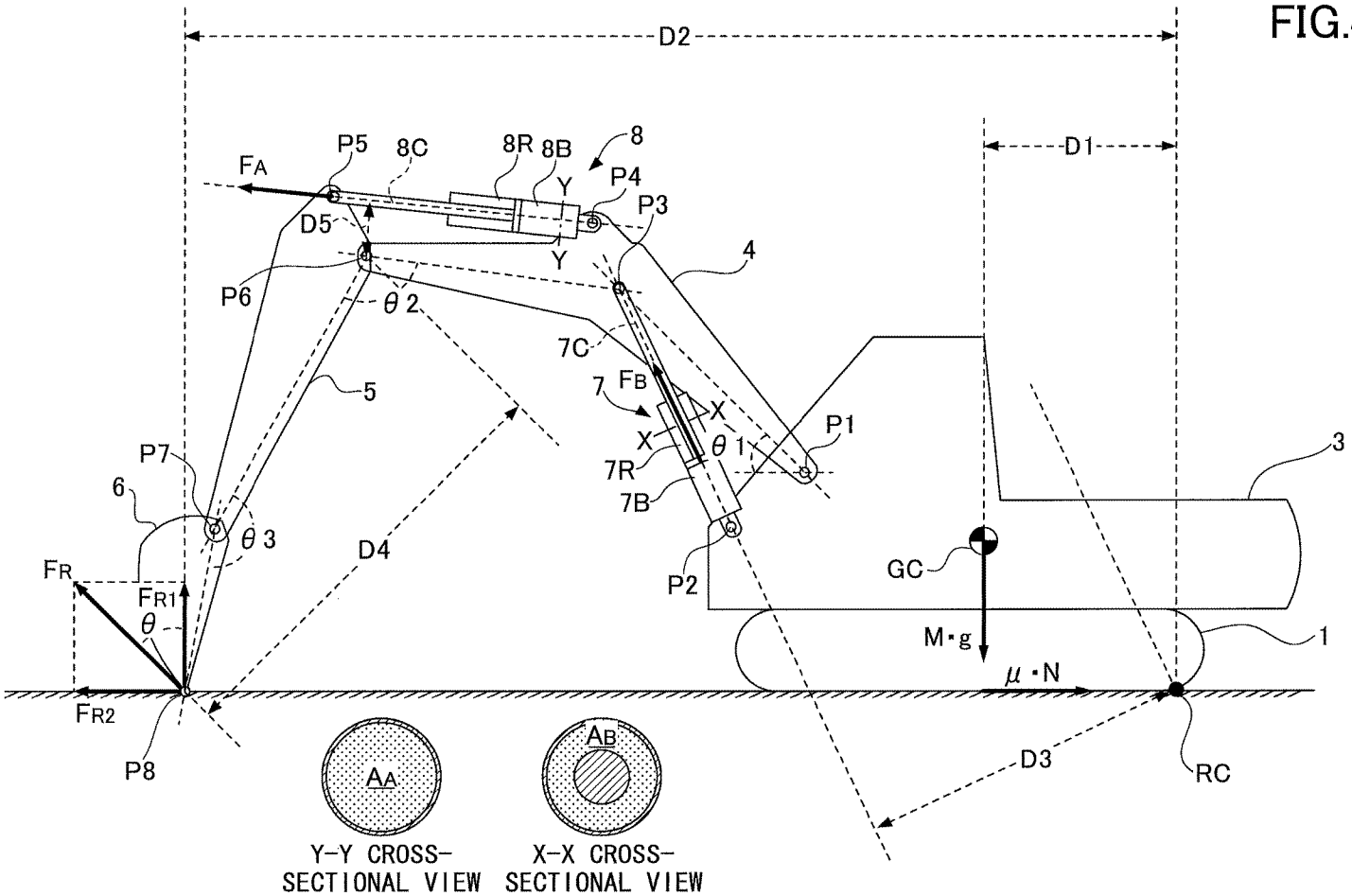
FIG. 4 is a schematic diagram illustrating the relationship between forces that act on the shovel when excavation by a complex excavation operation is performed.

Next, a description is given, with reference to FIG. 4, of detection of the position of the shovel by the position detection part 301 and calculation of a maximum allowable pressure by the maximum allowable pressure calculation part 302. FIG. 4 is a schematic diagram illustrating the relationship between forces that act on the shovel when excavation by a complex excavation operation is performed.

First, a description is given of parameters related to control for preventing a lift of the body during excavation work.

In FIG. 4, Point P1 indicates the juncture of the upper-part turning body 3 and the boom 4, and Point P2 indicates the juncture of the upper-part turning body 3 and the cylinder of the boom cylinder 7. Furthermore, Point P3 indicates the juncture of a rod 7C of the boom cylinder 7 and the boom 4, and Point P4 indicates the juncture of the boom 4 and the cylinder of the arm cylinder 8. Furthermore, Point P5 indicates the juncture of a rod 8C of the arm cylinder 8 and the arm 5, and Point P6 indicates the juncture of the boom 4 and the arm 5. Furthermore, Point P7 indicates the juncture of the arm 5 and the bucket 6, and Point P8 indicates the end of the bucket 6. For clarification of explanation, a graphical representation of the bucket cylinder 9 is omitted in FIG. 4.

Furthermore, FIG. 4 shows the angle between a straight line that connects Point P1 and P3 and a horizontal line as a boom angle θ1, the angle between a straight line that connects Point P3 and Point P6 and a straight line that connects Point P6 and Point P7 as an arm angle θ2, and the angle between the straight line that connects Point P6 and Point P7 and a straight line that connects Point P7 and Point P8 as a bucket angle θ3.

Furthermore, in FIG. 4, a distance D1 indicates a horizontal distance between a center of rotation RC and the center of gravity GC of the shovel, that is, a distance between the line of action of gravity M·g, which is the product of the mass M of the shovel and gravitational acceleration g, and the center of rotation RC, at the time of occurrence of a lift of the body. The product of the distance D1 and the magnitude of the gravity M·g represents the magnitude of a first moment of force around the center of rotation RC. Here, a symbol "·" represents "×" (a multiplication sign).

Furthermore, in FIG. 4, a distance D2 indicates a horizontal distance between the center of rotation RC and Point P8, that is, a distance between the line of action of the vertical component $F_{R1}$ of an excavation reaction force $F_R$ and the center of rotation RC. The product of the distance D2 and the magnitude of the vertical component $F_{R1}$ represents the magnitude of a second moment of force around the center of rotation RC. The excavation reaction force $F_R$ forms an excavation angle θ relative to a vertical axis, and the vertical component $F_{R1}$ of the excavation reaction force $F_R$ is expressed by $F_{R1}=F_R \cdot \cos\theta$. Furthermore, the excavation angle θ is calculated based on the boom angle θ1, the arm angle θ2, and the bucket angle θ3.

Furthermore, in FIG. 4, a distance D3 indicates a distance between a straight line that connects Point P2 and Point P3 and the center of rotation RC, that is, a distance between the line of action of a force $F_B$ to pull out the rod 7C of the boom cylinder 7 and the center of rotation RC. The product of the distance D3 and the magnitude of the force $F_B$ represents the magnitude of a third moment of force around the center of rotation RC.

Furthermore, in FIG. 4, a distance D4 indicates a distance between the line of action of the excavation reaction force $F_R$ and Point P6. The product of the distance D4 and the magnitude of the excavation reaction force $F_R$ represents the magnitude of a first moment of force around Point P6.

Furthermore, in FIG. 4, a distance D5 indicates a distance between a straight line that connects Point P4 and Point P5 and Point P6, that is, a distance between the line of action of an arm thrust $F_A$ to close the arm 5 and Point P6. The product of the distance D5 and the magnitude of the arm thrust $F_A$ represents a second moment of force around Point P6.

Here, it is assumed that the magnitude of a moment of force to lift the shovel around the center of rotation RC by the vertical component $F_{R1}$ of the excavation reaction force $F_R$ and the magnitude of a moment of force to lift the shovel around the center of rotation RC by the force $F_B$ to pull out the rod 7C of the boom cylinder 7 are interchangeable. In this case, the relationship between the magnitude of the second moment of force around the center of rotation RC and the magnitude of the third moment of force around the center of rotation RC is expressed by the following equation (1):

$$F_{R1} \cdot D2 = F_R \cdot \cos\theta \cdot D2 = F_B \cdot D3. \quad (1)$$

Furthermore, the magnitude of a moment of force to close the arm 5 around Point P6 by the arm thrust $F_A$ and the magnitude of a moment of force to open the arm 5 around Point P6 by the excavation reaction force $F_R$ are believed to balance each other. In this case, the relationship between the magnitude of the first moment of force around Point P6 and the magnitude of the second moment of force around Point P6 is expressed by the following equation (2) and equation (2)':

$$F_A \cdot D5 = F_R \cdot D4, \quad (2)$$

$$F_R = F_A \cdot D5 / D4, \quad (2)'$$

where a symbol "/" represents "÷" (a division sign).

Furthermore, from Eq. (1) and Eq. (2), the force $F_B$ to pull out the rod 7C of the boom cylinder 7 is expressed by the following equation (3):

$$F_B = F_A \cdot D2 \cdot D5 \cdot \cos\theta / (D3 \cdot D4). \quad (3)$$

Furthermore, letting the annular pressure receiving area of a piston that faces the rod-side oil chamber 7R of the boom cylinder 7 be an area $A_B$ as illustrated in an X-X cross-sectional view of FIG. 4, and letting the pressure of hydraulic oil in the rod-side oil chamber 7R be a pressure $P_B$, the force $F_S$ to pull out the rod 7C of the boom cylinder 7 is expressed by $F_B = P_B \cdot A_B$. Accordingly, Eq. (3) is expressed by the following equation (4) and equation (4)':

$$P_B = F_A \cdot D2 \cdot D5 \cdot \cos\theta / (A_B \cdot D3 \cdot D4), \quad (4)$$

$$F_A = P_S \cdot A_B \cdot D3 \cdot D4 / (D2 \cdot D5 \cdot \cos\theta). \quad (4)'$$

Here, letting the force $F_B$ to pull out the rod 7C of the boom cylinder 7 at the time of a lift of the body be a force $F_{BMAX}$, the magnitude of the first moment of force around the center of rotation RC to prevent a lift of the body by the gravity M·g and the magnitude of the third moment of force around the center of rotation RC to lift the body by the force $F_{BMAX}$ are believed to balance each other. In this case, the relationship between the magnitudes of the two moments of force is expressed by the following equation (5):

$$M \cdot g \cdot D1 = F_{BMAX} \cdot D3. \quad (5)$$

Furthermore, letting the pressure of hydraulic oil in the rod-side oil chamber 7R of the boom cylinder 7 at this point be a maximum allowable pressure $P_{BMAX}$ used for prevention of a lift of the body (hereinafter, "first maximum allowable pressure"), the first maximum allowable pressure $P_{BMAX}$ is expressed by the following equation (6):

$$P_{BMAX} = M \cdot g \cdot D1 / (A_B \cdot D3). \quad (6)$$

Furthermore, the distance D1 is a constant, and like the excavation angle θ, the distances D2 through D5 are values determined according to the position of the excavation attachment, that is, the boom angle θ1, the arm angle θ2, and the bucket angle θ3. Specifically, the distance D2 is determined according to the boom angle θ1, the arm angle θ2, and the bucket angle θ3, the distance D3 is determined according to the boom angle θ1, the distance D4 is determined according to the bucket angle θ3, and the distance D5 is determined according to the arm angle θ2.

As a result, it is possible for the maximum allowable pressure calculation part 302 to calculate the first maximum allowable pressure $P_{BMAX}$ using the boom angle θ1 detected by the position detection part 301 and Eq. (6).

Furthermore, it is possible for the boom cylinder pressure control part 303 to prevent a lift of the body of the shovel by maintaining the pressure $P_B$ in the rod-side oil chamber 7R of the boom cylinder 7 at a predetermined pressure that is less than or equal to the first maximum allowable pressure $P_{BMAX}$. Specifically, the boom cylinder pressure control part 303 decreases the pressure $P_B$ by increasing the flow rate of hydraulic oil that flows out from the rod-side oil chamber 7R into a tank when the pressure $P_B$ reaches the predetermined pressure. This is because a decrease in the pressure $P_B$ causes a decrease in the arm thrust $F_A$ as shown by Eq. (4)' so as to further cause a decrease in the excavation reaction force $F_R$ as shown by Eq. (2)', thus causing a decrease in its vertical component $F_{R1}$.

Furthermore, the position of the center of rotation RC is determined based on the output of the turning angle sensor 32D. For example, when the turning angle between the lower-part traveling body 1 and the upper-part turning body 3 is zero degrees, a rear end of part of the lower-part traveling body 1 that comes into contact with ground serves as the center of rotation RC, and when the turning angle between the lower-part traveling body 1 and the upper-part turning body 3 is 180 degrees, a front end of part of the lower-part traveling body 1 that comes into contact with ground serves as the center of rotation RC. Furthermore, when the turning angle between the lower-part traveling body 1 and the upper-part turning body 3 is 90 degrees or 270 degrees, a side end of part of the lower-part traveling body 1 that comes into contact with ground serves as the center of rotation RC.

Next, a description is given of parameters related to control for preventing the body from being dragged toward an excavation point during excavation work.

The relationship between forces to move the body in horizontal directions during excavation work is expressed by the following expression (7):

$$\mu \cdot N \geq F_{R2}. \quad (7)$$

A coefficient of static friction μ represents the coefficient of static friction of a ground surface contacted by the shovel, a normal force N represents a normal force against the gravity M·g of the shovel, and a force $F_{R2}$ represents the horizontal component $F_{R2}$ of the excavation reaction force $F_R$ to drag the shovel toward an excavation point. Furthermore, friction force μ·N represents a maximum static friction force to cause the shovel to be stationary. When the horizontal component $F_{R2}$ of the excavation reaction force $F_R$ exceeds the maximum static friction force μ·N, the shovel is dragged toward an excavation point. The coefficient of static friction μ may be a value prestored in a ROM or the like or be dynamically calculated based on various kinds of information. According to this embodiment, the coefficient of static friction μ is a prestored value selected by an operator via an input device (not graphically represented). The operator selects a desired friction condition (coefficient of static friction) from multiple levels of friction conditions (coefficients of static friction) in accordance with the contacted ground surface.

Here, the horizontal component $F_{R2}$ of the excavation reaction force $F_R$ is expressed by $F_{R2}=F_R \cdot \sin\theta$, and the excavation reaction force $F_R$ is expressed by $F_R=F_A \cdot D5/D4$ from Eq. (2)'. Therefore, the expression (7) is expressed by the following expression (8):

$$\mu \cdot M \cdot g \geq F_A \cdot D5 \cdot \sin\theta / D4. \quad (8)$$

Furthermore, letting the circular pressure receiving area of a piston that faces the bottom-side oil chamber 8B of the arm cylinder 8 be an area $A_A$ as illustrated in a Y-Y cross-sectional view of FIG. 4, and letting the pressure of hydraulic oil in the bottom-side oil chamber 8B be a pressure $P_A$, the arm thrust $F_A$ is expressed by $F_A=P_A \cdot A_A$. Therefore, the expression (8) is expressed by the following expression (9):

$$P_A \leq \mu \cdot M \cdot g \cdot D4 / (A_A \cdot D5 \cdot \sin\theta). \quad (9)$$

Here, the pressure $P_A$ of hydraulic oil in the bottom-side oil chamber 8B of the arm cylinder 8 at the time when the right side and the left side of the expression (9) are equal corresponds to a maximum allowable pressure that can avoid the body being dragged toward an excavation point, that is, a maximum allowable pressure $P_{AMAX}$ used to prevent the body from being dragged toward an excavation point (hereinafter, "second maximum allowable pressure").

From the above-described relationships, it is possible for the maximum allowable pressure calculation part 302 to calculate the second maximum allowable pressure $P_{AMAX}$ using the boom angle θ1, the arm angle θ2, and the bucket angle θ3 detected by the position detection part 301 and using the expression (9).

Furthermore, it is possible for the arm cylinder pressure control part 304 to prevent the body of the shovel from being dragged toward an excavation point by maintaining the pressure $P_A$ in the bottom-side oil chamber 8B of the arm cylinder 8 at a predetermined pressure that is less than or equal to the second maximum allowable pressure $P_{AMAX}$. Specifically, the arm cylinder pressure control part 304 decreases the pressure $P_A$ by decreasing the flow rate of hydraulic oil that flows from the main pump 14L into the bottom-side oil chamber 8B when the pressure $P_A$ reaches the predetermined pressure. This is because a decrease in the pressure $P_A$ causes a decrease in the arm thrust $F_A$ so as to further cause a decrease in the horizontal component $F_{R1}$ of the excavation reaction force $F_R$.

Figure 5:
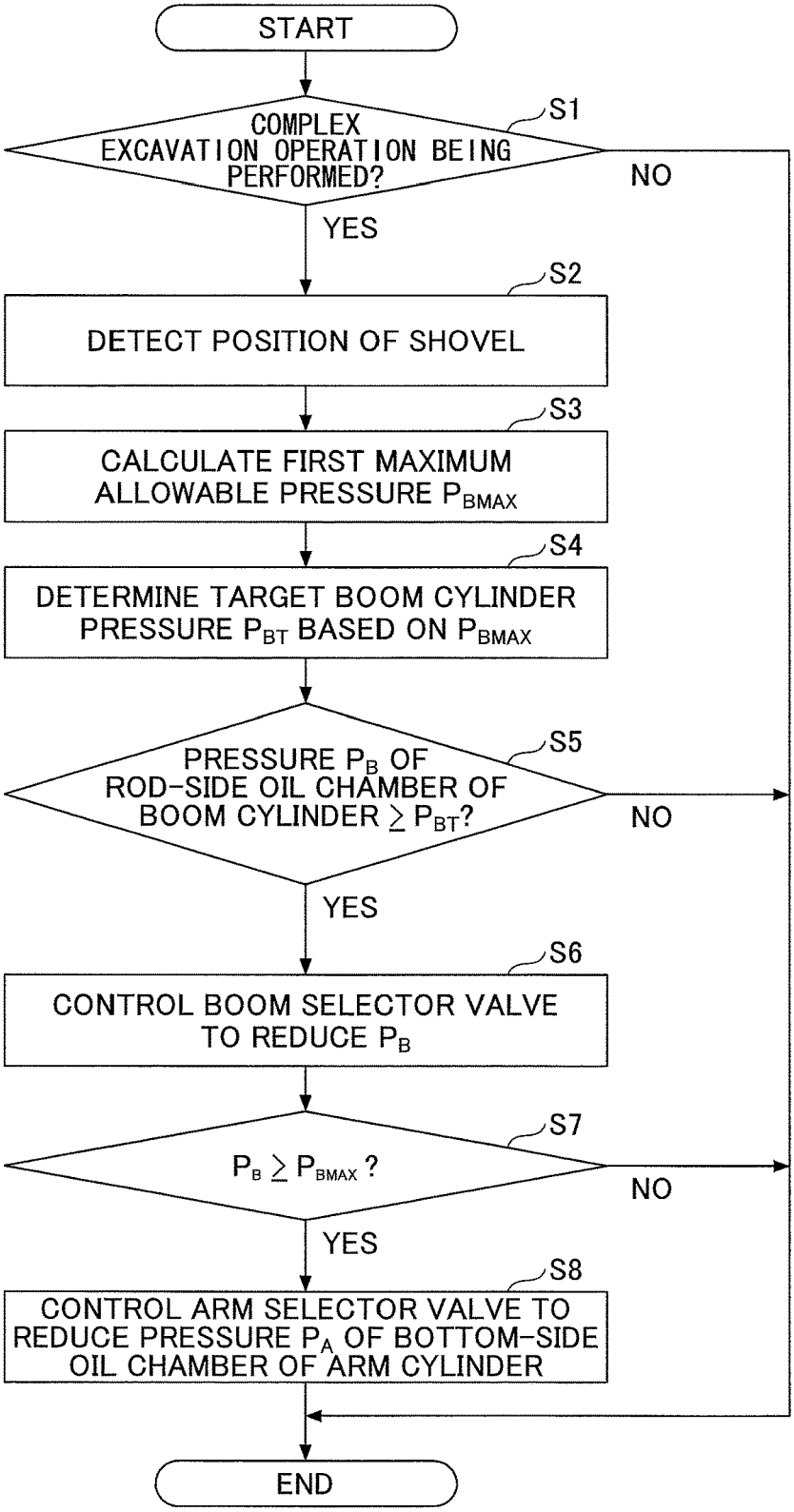
FIG. 5 is a flowchart illustrating a flow of a first complex excavation work support process.

Next, a description is given, with reference to FIG. 5, of a process of the excavation support system 100 supporting complex excavation work while preventing a lift of the body of the shovel (hereinafter, "first complex excavation work support process"). FIG. 5 is a flowchart illustrating a flow of the first complex excavation work support process. The controller 30 of the excavation support system 100 repeatedly executes this first complex excavation work support process at predetermined intervals.

First, the excavation operation detection part 300 of the controller 30 determines whether a complex excavation operation including a boom raising operation and an arm closing operation is being performed (step S1). Specifically, the excavation operation detection part 300 detects whether a boom raising operation is being performed based on the output of the pressure sensor 29B. Then, in response to detecting that a boom raising operation is being performed, the excavation operation detection part 300 obtains the pressure of the rod-side oil chamber 7R of the boom cylinder 7 based on the output of the pressure sensor 31B. Furthermore, the excavation operation detection part 300 calculates a pressure difference by subtracting the pressure of the rod-side oil chamber 8R from the pressure of the bottom-side oil chamber 8B of the arm cylinder 8 based on the outputs of the pressure sensors 31A and 31C. Then, the excavation operation detection part 300 determines that a complex excavation operation is being performed in response to the pressure of the rod-side oil chamber 7R being a predetermined value α or more and the calculated pressure difference being a predetermined value β or more.

If the excavation operation detection part 300 determines that no complex excavation operation is being performed (NO at step S1), the controller 30 ends the first complex excavation work support process of this time.

On the other hand, if the excavation operation detection part 300 determines that a complex excavation operation is being performed (YES at step S1), the position detection part 301 detects the position of the shovel (step S2). Specifically, the position detection part 301 detects the boom angle θ1, the arm angle θ2, and the bucket angle θ3 based on the outputs of the arm angle sensor 32A, the boom angle sensor 32B, and the bucket angle sensor 32C. This is to make it possible for the maximum allowable pressure calculation part 302 of the controller 30 to obtain a distance between the line of action of a force applied on the excavation attachment and a predetermined center of rotation.

Thereafter, the maximum allowable pressure calculation part 302 calculates the first maximum allowable pressure based on a detection value of the position detection part 301 (step S3). Specifically, the maximum allowable pressure calculation part 302 calculates the first maximum allowable pressure $P_{BMAX}$ using Eq. (6) described above.

Thereafter, the maximum allowable pressure calculation part 302 determines a predetermined pressure less than or equal to the calculated first maximum allowable pressure $P_{BMAX}$ as a target boom cylinder pressure $P_{BT}$ (step S4). Specifically, the maximum allowable pressure calculation part 302 determines a value obtained by subtracting a predetermined value from the first maximum allowable pressure $P_{BMAX}$ as the target boom cylinder pressure $P_{BT}$.

Thereafter, the boom cylinder pressure control part 303 of the controller 30 monitors the pressure $P_B$ of hydraulic oil in the rod-side oil chamber 7R of the boom cylinder 7. If the pressure $P_B$ increases as the complex excavation work progresses, so as to reach the target boom cylinder pressure $P_{BT}$ (YES at step S5), the boom cylinder pressure control part 303 controls the boom selector valve 17B to reduce the pressure $P_B$ of the rod-side oil chamber 7R of the boom cylinder 7 (step S6). Specifically, the boom cylinder pressure control part 303 supplies a control current to the electromagnetic proportional valve 42 so as to increase a pilot pressure applied on the pilot port for a boom raising operation. Then, the boom cylinder pressure control part 303 reduces the pressure $P_B$ of the rod-side oil chamber 7R by increasing the amount of hydraulic oil flowing out from the rod-side oil chamber 7R to a tank. As a result, the rising speed of the boom 4 increases so as to decrease the vertical component $F_{R1}$ of the excavation reaction force $F_R$, so that the body of the shovel is prevented from being lifted.

Thereafter, the arm cylinder pressure control part 304 continues to monitor the pressure $P_B$ of hydraulic oil in the rod-side oil chamber 7R of the boom cylinder 7. If the pressure $P_B$ further increases in spite of an increase in the rising speed of the boom 4 so as to reach the first maximum allowable pressure $P_{BMAX}$ (YES at step S7), the arm cylinder pressure control part 304 controls the arm selector valve 17A to reduce the pressure $P_A$ of the boom-side oil chamber 8B of the arm cylinder 8 (step S8). Specifically, the arm cylinder pressure control part 304 supplies a control current to the electromagnetic proportional valve 41 so as to reduce a pilot pressure applied on the pilot port for an arm closing operation. Then, the arm cylinder pressure control part 304 reduces the pressure $P_A$ of the bottom-side oil chamber 8B by reducing the amount of hydraulic oil flowing from the main pump 14L into the bottom-side oil chamber 8B. As a result, the closing speed of the arm 5 decreases so as to decrease the vertical component $F_{R1}$ of the excavation reaction force $F_R$, so that the body of the shovel is prevented from being lifted. If the pressure $P_B$ does not fall below the first maximum allowable pressure $P_{BMAX}$ in spite of a decrease in the closing speed of the arm 5, the arm cylinder pressure control part 304 may cause the amount of hydraulic oil flowing from the main pump 14L into the bottom-side oil chamber 8B to be zero. In this case, the stoppage of the movement of the arm 5 eliminates the vertical component $F_{R1}$ of the excavation reaction force $F_R$, so that the body of the shovel is prevented from being lifted.

If the pressure $P_B$ remains below the target boom cylinder pressure $P_{BT}$ at step S5 (NO at step S5), the boom cylinder pressure control part 303 ends the first complex excavation work support process of this time without reducing the pressure $P_B$ of the rod-side oil chamber 7R of the boom cylinder 7. This is because there is no possibility of a lift of the body of the shovel.

Likewise, if the pressure $P_S$ remains below the target boom cylinder pressure $P_{BT}$ at step S7 (NO at step S7), the arm cylinder pressure control part 304 ends the first complex excavation work support process of this time without reducing the pressure $P_A$ of the bottom-side oil chamber 8B of the arm cylinder 8. This is because there is no possibility of a lift of the body of the shovel.

With the above-described configuration, it is possible for the excavation support system 100 to prevent a lift of the body of the shovel during complex excavation work. Therefore, it is possible to realize complex excavation work that makes efficient use of the body weight at a point immediately before a lift of the body of the shovel. Furthermore, it is possible to achieve improvement in work efficiency, such as dispensation of an operation for returning the lifted shovel to its original position, so that it is possible to lower fuel consumption, prevent a body failure, and reduce operation loads on the operator.

Furthermore, the excavation support system 100 prevents a lift of the body of the shovel during complex excavation work by adjusting a boom raising operation using the boom operation lever 26B by the operator. Therefore, the operator is prevented from having a strange feeling that the boom 4 rises in spite of the absence of operation of the boom operation lever 26B.

Furthermore, the excavation support system 100 prevents a lift of the body of the shovel by adjusting an arm closing operation by the operator when determining that a lift of the body is still unavoidable even by adjusting the boom raising operation. Such employment of a two-step lift preventing measure makes it possible for the excavation support system 100 to ensure prevention of a lift of the body while realizing complex excavation work that makes maximum use of the body weight.

Figure 6:
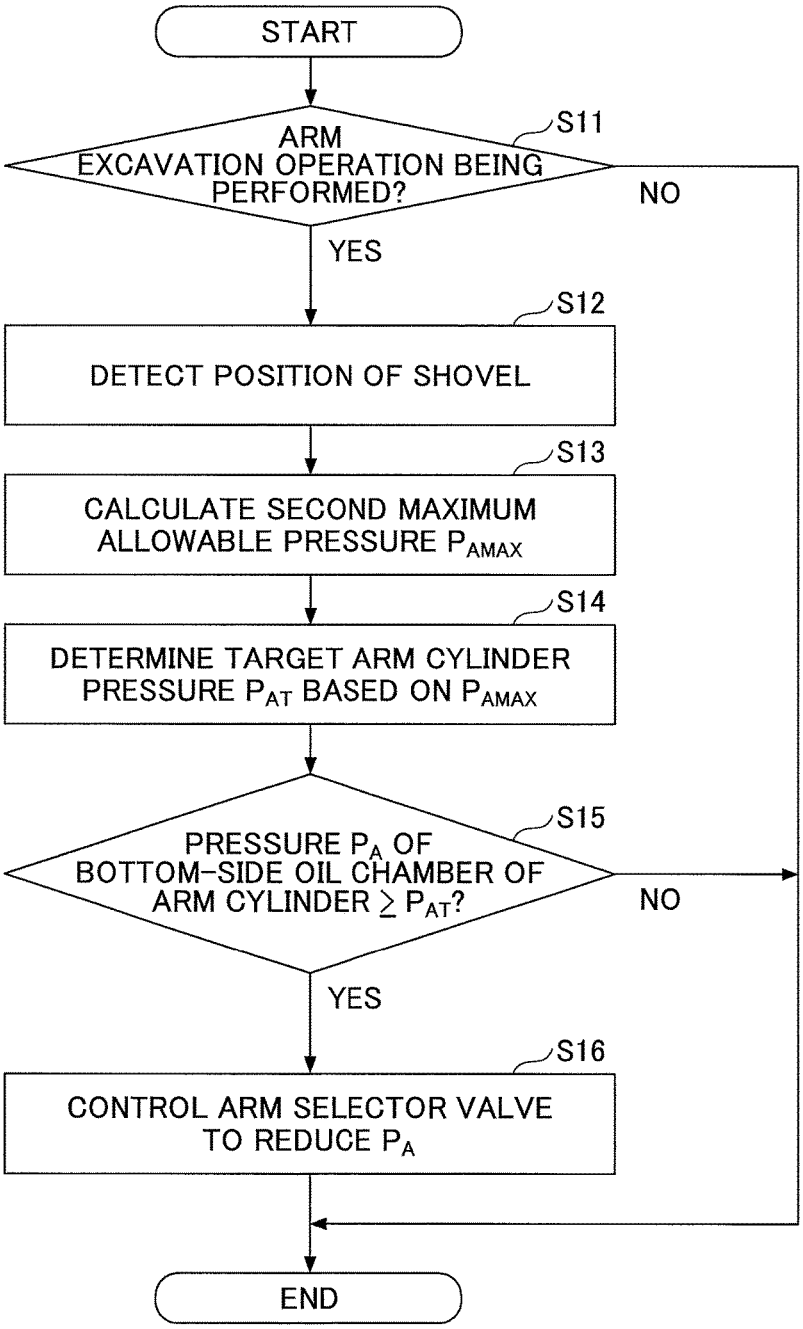
FIG. 6 is a flowchart illustrating a flow of an arm excavation work support process.

Next, a description is given, with reference to FIG. 6, of a process of the excavation support system 100 supporting arm excavation work while preventing the body of the shovel from being dragged toward an excavation point (hereinafter, "arm excavation work support process"). FIG. 6 is a flowchart illustrating a flow of the arm excavation work support process. The controller 30 of the excavation support system 100 repeatedly executes this arm excavation work support process at predetermined intervals.

First, the excavation operation detection part 300 of the controller 30 determines whether an arm excavation operation including an arm closing operation is being performed (step S11). Specifically, the excavation operation detection part 300 detects whether an arm closing operation is being performed based on the output of the pressure sensor 29A. Then, in response to detecting that an arm closing operation is being performed, the excavation operation detection part 300 calculates a pressure difference by subtracting the pressure of the rod-side oil chamber 8R from the pressure of the bottom-side oil chamber 8B of the arm cylinder 8 based on the outputs of the pressure sensors 31A and 31C. Then, the excavation operation detection part 300 determines that an arm closing operation is being performed in response to the calculated pressure difference being a predetermined value $\gamma$ or more.

If the excavation operation detection part 300 determines that no arm closing operation is being performed (NO at step S11), the controller 30 ends the arm excavation work support process of this time.

On the other hand, if the excavation operation detection part 300 determines that an arm closing operation is being performed (YES at step S11), the position detection part 301 detects the position of the shovel (step S12). Specifically, the position detection part 301 detects the boom angle $\theta$1, the arm angle $\theta$2, and the bucket angle $\theta$3 based on the outputs of the arm angle sensor 32A, the boom angle sensor 32B, and the bucket angle sensor 32C. This is to make it possible for the maximum allowable pressure calculation part 302 of the controller 30 to obtain the excavation angle $\theta$, the distance D4, the distance D5, etc.

Thereafter, the maximum allowable pressure calculation part 302 calculates the second maximum allowable pressure based on detection values of the position detection part 301 (step S13). Specifically, the maximum allowable pressure calculation part 302 calculates the second maximum allowable pressure $P_{AMAX}$ using the above-described expression (9).

Thereafter, the maximum allowable pressure calculation part 302 determines a predetermined pressure less than or equal to the calculated second maximum allowable pressure $P_{AMAX}$ as a target arm cylinder pressure $P_{AT}$. (step S14). According to this embodiment, the maximum allowable pressure calculation part 302 determines the second maximum allowable pressure $P_{AMAX}$ as the target arm cylinder pressure $P_{AT}$.

Thereafter, the arm cylinder pressure control part 304 of the controller 30 monitors the pressure $P_A$ of hydraulic oil in the bottom-side oil chamber 8B of the arm cylinder 8. If the pressure $P_A$ increases as the arm excavation work progresses, so as to reach the target arm cylinder pressure $P_{AT}$ (YES at step S15), the arm cylinder pressure control part 304 controls the arm selector valve 17A to reduce the pressure $P_A$ of the bottom-side oil chamber 8B of the arm cylinder 8 (step S16). Specifically, the arm cylinder pressure control part 304 supplies a control current to the electromagnetic proportional valve 41 so as to decrease a pilot pressure applied on the pilot port for an arm closing operation. Then, the arm cylinder pressure control part 304 reduces the pressure $P_A$ of the bottom-side oil chamber 8B by reducing the amount of hydraulic oil flowing from the main pump 14L into the bottom-side oil chamber 8B. As a result, the closing speed of the arm 5 decreases so as to decrease the horizontal component $F_{R2}$ of the excavation reaction force $F_R$, so that the body of the shovel is prevented from being dragged toward an excavation point.

If the pressure $P_A$ does not fall below the second maximum allowable pressure $P_{AMAX}$ in spite of a decrease in the closing speed of the arm 5, the arm cylinder pressure control part 304 may cause the amount of hydraulic oil flowing from the main pump 14L into the bottom-side oil chamber 8B to be zero. In this case, the stoppage of the movement of the arm 5 eliminates the horizontal component $F_{R2}$ of the excavation reaction force $F_R$, so that the body of the shovel is prevented from being dragged toward an excavation point.

If the pressure $P_A$, remains below the target arm cylinder pressure $P_{AT}$ at step S15 (NO at step S15), the arm cylinder pressure control part 304 ends the arm excavation work support process of this time without reducing the pressure $P_A$ of the bottom-side oil chamber 8B of the arm cylinder 8. This is because there is no possibility of the body of the shovel being dragged.

With the above-described configuration, it is possible for the excavation support system 100 to prevent the body of the shovel from being dragged toward an excavation point during arm excavation work. Therefore, it is possible to realize arm excavation work that makes efficient use of the body weight at a point immediately before the body of the shovel is dragged. Furthermore, it is possible to achieve improvement in work efficiency, such as dispensation of an operation for returning the dragged shovel to its original position, so that it is possible to lower fuel consumption, prevent a body failure, and reduce operation loads on the operator.

Figure 7:
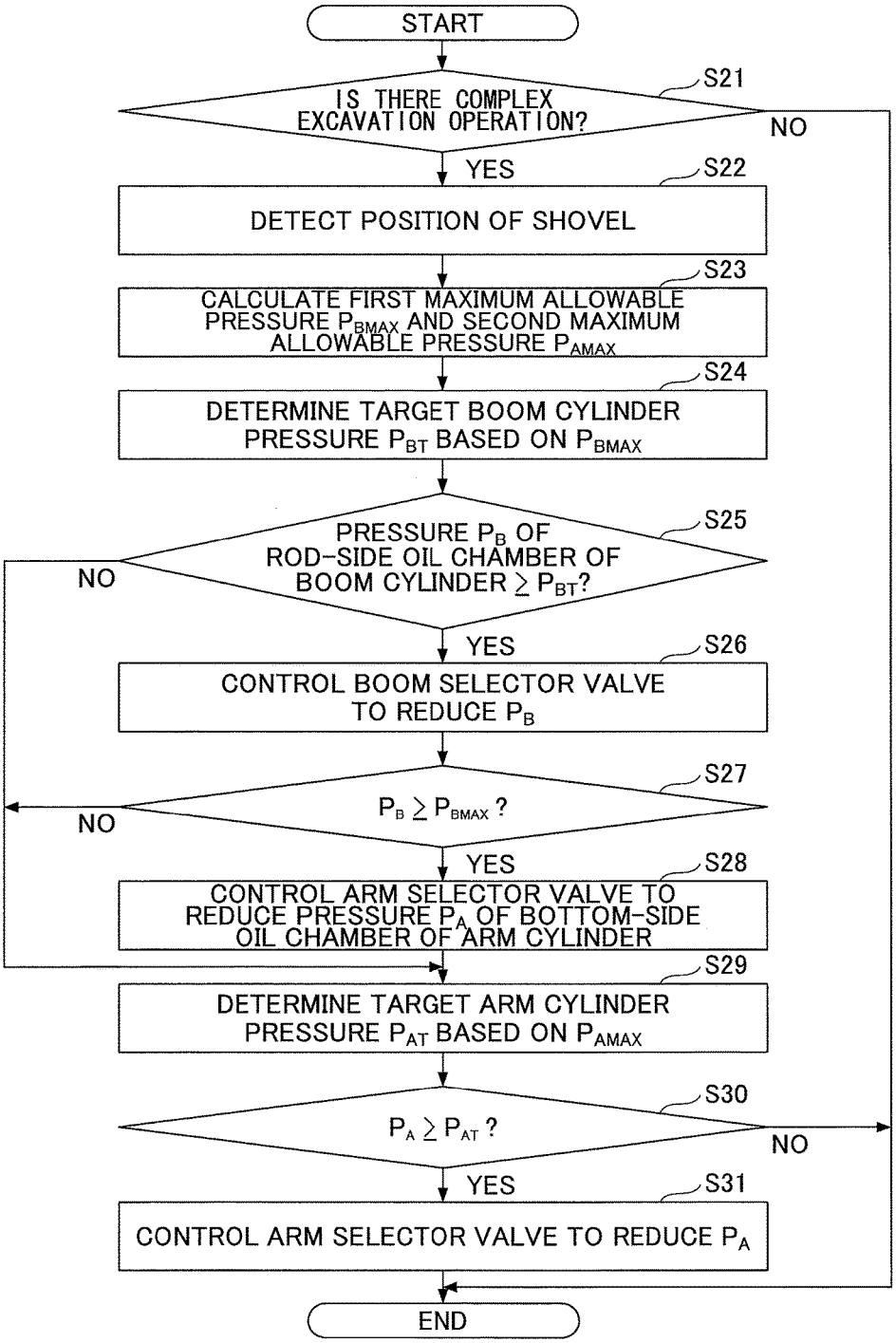
FIG. 7 is a flowchart illustrating a flow of a second complex excavation work support process.

Next, a description is given, with reference to FIG. 7, of a process of the excavation support system 100 supporting complex excavation work while preventing the body of the shovel from being lifted and the body of the shovel from being dragged toward an excavation point (hereinafter, "second complex excavation work support process"). FIG. 7 is a flowchart illustrating a flow of the second complex excavation work support process. The controller 30 of the excavation support system 100 repeatedly executes this second complex excavation work support process at predetermined intervals.

First, the excavation operation detection part 300 of the controller 30 determines whether a complex excavation operation including a boom raising operation and an arm closing operation is being performed (step S21). Specifically, the excavation operation detection part 300 detects whether a boom raising operation is being performed based on the output of the pressure sensor 29B. Then, in response to detecting that a boom raising operation is being performed, the excavation operation detection part 300 obtains the pressure of the rod-side oil chamber 7R of the boom cylinder 7 based on the output of the pressure sensor 31B. Furthermore, the excavation operation detection part 300 calculates a pressure difference by subtracting the pressure of the rod-side oil chamber 8R from the pressure of the bottom-side oil chamber 8B of the arm cylinder 8 based on the outputs of the pressure sensors 31A and 31C. Then, the excavation operation detection part 300 determines that a complex excavation operation is being performed in response to the pressure of the rod-side oil chamber 7R being a predetermined value $\alpha$ or more and the calculated pressure difference being a predetermined value $\beta$ or more.

If the excavation operation detection part 300 determines that no complex excavation operation is being performed (NO at step S21), the controller 30 ends the second complex excavation work support process of this time.

On the other hand, if the excavation operation detection part 300 determines that a complex excavation operation is being performed (YES at step S21), the position detection part 301 detects the position of the shovel (step S22). Specifically, the position detection part 301 detects the boom angle $\theta 1$, the arm angle $\theta 2$, and the bucket angle $\theta 3$ based on the outputs of the arm angle sensor 32A, the boom angle sensor 32B, and the bucket angle sensor 32C. This is to make it possible for the maximum allowable pressure calculation part 302 of the controller 30 to obtain the excavation angle $\theta$, the distance D3, the distance D4, the distance D5, etc.

Thereafter, the maximum allowable pressure calculation part 302 calculates the first maximum allowable pressure and the second maximum allowable pressure based on detection values of the position detection part 301 (step S23). Specifically, the maximum allowable pressure calculation part 302 calculates the first maximum allowable pressure $P_{BMAX}$ using Eq. (6) described above and calculates the second maximum allowable pressure $P_{AMAX}$ using the above-described expression (9).

Thereafter, the maximum allowable pressure calculation part 302 determines a predetermined pressure less than or equal to the calculated first maximum allowable pressure $P_{BMAX}$ as a target boom cylinder pressure $P_{BT}$ (step S24). Specifically, the maximum allowable pressure calculation part 302 determines a value obtained by subtracting a predetermined value from the first maximum allowable pressure $P_{BMAX}$ as the target boom cylinder pressure $P_{BT}$.

Thereafter, the boom cylinder pressure control part 303 of the controller 30 monitors the pressure $P_B$ of hydraulic oil in the rod-side oil chamber 7R of the boom cylinder 7. If the pressure $P_B$ increases as the complex excavation work progresses, so as to reach the target boom cylinder pressure $P_{BT}$ (YES at step S25), the boom cylinder pressure control part 303 controls the boom selector valve 17B to reduce the pressure $P_B$ of the rod-side oil chamber 7R of the boom cylinder 7 (step S26). Specifically, the boom cylinder pressure control part 303 supplies a control current to the electromagnetic proportional valve 42 so as to increase a pilot pressure applied on the pilot port for a boom raising operation. Then, the boom cylinder pressure control part 303 reduces the pressure $P_B$ of the rod-side oil chamber 7R by increasing the amount of hydraulic oil flowing out from the rod-side oil chamber 7R to a tank. As a result, the rising speed of the boom 4 increases so as to decrease the vertical component $F_{R1}$ of the excavation reaction force $F_R$, so that the body of the shovel is prevented from being lifted.

Thereafter, the arm cylinder pressure control part 304 continues to monitor the pressure $P_B$ of hydraulic oil in the rod-side oil chamber 7R of the boom cylinder 7. If the pressure $P_B$ further increases in spite of an increase in the rising speed of the boom 4 so as to reach the first maximum allowable pressure $P_{BMAX}$ (YES at step S27), the arm cylinder pressure control part 304 controls the arm selector valve 17A to reduce the pressure $P_A$ of the boom-side oil chamber 8B of the arm cylinder 8 (step S28). Specifically, the arm cylinder pressure control part 304 supplies a control current to the electromagnetic proportional valve 41 so as to reduce a pilot pressure applied on the pilot port for an arm closing operation. Then, the arm cylinder pressure control part 304 reduces the pressure $P_A$ of the bottom-side oil chamber 8B by reducing the amount of hydraulic oil flowing from the main pump 14L into the bottom-side oil chamber 8B. As a result, the closing speed of the arm 5 decreases so as to decrease the vertical component $F_{R1}$ of the excavation reaction force $F_R$, so that the body of the shovel is prevented from being lifted. If the pressure $P_B$ does not fall below the first maximum allowable pressure $P_{BMAX}$ in spite of a decrease in the closing speed of the arm 5, the arm cylinder pressure control part 304 may cause the amount of hydraulic oil flowing from the main pump 14L into the bottom-side oil chamber 8B to be zero. In this case, the stoppage of the movement of the arm 5 eliminates the vertical component $F_{R1}$ of the excavation reaction force $F_R$, so that the body of the shovel is prevented from being lifted.

If the pressure $P_B$ remains below the target boom cylinder pressure $P_{BT}$ at step S25 (NO at step S25), the controller 30 advances the process to step S29 without reducing the pressure $P_B$ of the rod-side oil chamber 7R of the boom cylinder 7. This is because there is no possibility of a lift of the body of the shovel.

Likewise, if the pressure $P_B$ remains below the target boom cylinder pressure $P_{BT}$ at step S27 (NO at step S27), the controller 30 advances the process to step S29 without reducing the pressure $P_B$ of the rod-side oil chamber 7R of the boom cylinder 7. This is because there is no possibility of a lift of the body of the shovel.

Thereafter, at step S29, the maximum allowable pressure calculation part 302 determines a predetermined pressure less than or equal to the calculated second maximum allowable pressure $P_{AMAX}$ as a target arm cylinder pressure $P_{AT}$. Specifically, the maximum allowable pressure calculation part 302 determines the second maximum allowable pressure $P_{AMAX}$ as the target arm cylinder pressure $P_{AT}$.

Thereafter, the arm cylinder pressure control part 304 of the controller 30 monitors the pressure $P_A$ of hydraulic oil in the bottom-side oil chamber 8B of the arm cylinder 8. If the pressure $P_A$ increases as the arm excavation work progresses, so as to reach the target arm cylinder pressure $P_{AT}$ (YES at step S29), the arm cylinder pressure control part 304 controls the arm selector valve 17A to reduce the pressure $P_A$ of the bottom-side oil chamber 8B of the arm cylinder 8 (step S30). Specifically, the arm cylinder pressure control part 304 supplies a control current to the electromagnetic proportional valve 41 so as to decrease a pilot pressure applied on the pilot port for an arm closing operation. Then, the arm cylinder pressure control part 304 reduces the pressure $P_A$ of the bottom-side oil chamber 8B by reducing the amount of hydraulic oil flowing from the main pump 14L into the bottom-side oil chamber 8B. As a result, the closing speed of the arm 5 decreases so as to decrease the horizontal component $F_{R2}$ of the excavation reaction force $F_R$, so that the body of the shovel is prevented from being dragged toward an excavation point.

If the pressure $P_A$ does not fall below the second maximum allowable pressure $P_{AMAX}$ in spite of a decrease in the closing speed of the arm 5, the arm cylinder pressure control part 304 may cause the amount of hydraulic oil flowing from the main pump 14L into the bottom-side oil chamber 8B to be zero. In this case, the stoppage of the movement of the arm 5 eliminates the horizontal component $F_{R2}$ of the excavation reaction force $F_R$, so that the body of the shovel is prevented from being dragged toward an excavation point.

If the pressure $P_A$ remains below the target arm cylinder pressure $P_{AT}$ at step S30 (NO at step S30), the arm cylinder pressure control part 304 ends the second complex excavation work support process of this time without reducing the pressure $P_A$ of the bottom-side oil chamber 8B of the arm cylinder 8. This is because there is no possibility of the body of the shovel being dragged.

The order of a series of processes for preventing a lift of the shovel at step S24 through step S28 and a series of processes for preventing the shovel from being dragged at step S29 through step S31 is random. Accordingly, the two series of processes may be simultaneously performed in parallel, or the series of processes for preventing the shovel from being dragged may be performed before the series of processes for preventing a lift of the shovel.

With the above-described configuration, it is possible for the excavation support system 100 to prevent the body of the shovel from being lifted or dragged toward an excavation point during complex excavation work. Therefore, it is possible to realize complex excavation work that makes efficient use of the body weight at a point immediately before the body of the shovel is lifted or dragged. Furthermore, it is possible to achieve improvement in work efficiency, such as dispensation of an operation for returning the lifted or dragged shovel to its original position, so that it is possible to lower fuel consumption, prevent a body failure, and reduce operation loads on the operator.

A detailed description is given above of a shovel and a method of controlling a shovel based on a preferred embodiment of the present invention. The present invention, however, is not limited to the above-described embodiment, and variations and replacements may be applied to the above-described embodiment without departing from the scope of the present invention.

For example, according to the above-described embodiment, operations by the maximum allowable pressure calculation part 302, the boom cylinder pressure control part 303, and the arm cylinder pressure control part 304 are performed on the assumption that a surface contacted by the shovel is a horizontal surface. The present invention, however, is not limited to this. Various kinds of operations in the above-described embodiment may be properly performed by additionally taking the output of the inclination angle sensor 32E into consideration, even when the surface contacted by the shovel is an inclined surface.

Furthermore, according to the above-described embodiment, the excavation support system 100 prevents a lift of the body during a complex excavation operation that includes an arm closing operation and a boom raising operation. Specifically, the excavation support system 100 raises the boom 4 in response to the pressure of the rod-side oil chamber 7R of the boom cylinder 7 exceeding the target boom cylinder pressure $P_{BT}$. Furthermore, the excavation support system 100 reduces the closing speed of the arm 5 in response to the pressure of the rod-side oil chamber 7R reaching the first maximum allowable pressure $P_{BMAX}$. In this manner, the excavation support system 100 prevents a lift of the body of the shovel during a complex excavation operation including an arm closing operation and a boom raising operation. The present invention, however, is not limited to this. For example, the excavation support system 100 may be configured to prevent a lift of the body of the shovel during a complex excavation operation including a bucket closing operation and a boom raising operation. In this case, the excavation support system 100 raises the boom 4 in response to the pressure of the rod-side oil chamber 7R of the boom cylinder 7 exceeding the target boom cylinder pressure $P_{BT}$. Furthermore, the excavation support system 100 reduces the closing speed of the bucket 6 in response to the pressure of the rod-side oil chamber 7R reaching the first maximum allowable pressure $P_{BMAX}$. In this manner, the excavation support system 100 may prevent a lift of the body of the shovel during a complex excavation operation including a bucket closing operation and a boom raising operation.

Furthermore, hydraulic cylinders such as the boom cylinder 7 and the arm cylinder 8, which are moved by hydraulic oil discharged by the engine-driven main pump 14 according to the above-described embodiment, may alternatively be moved by hydraulic oil discharged by a hydraulic pump driven by an electric motor.

What is claimed is:

1. A shovel, comprising:

a body, the body including a lower-part traveling body; and an upper-part turning body mounted on the lower-part traveling body;

an excavation attachment attached to the upper-part turning body;

a hydraulic cylinder configured to move the excavation attachment; and a controller configured to prevent the shovel from being dragged by an excavation reaction force acting on the body by controlling a pressure of the hydraulic cylinder so as to prevent an increase in or reduce the excavation reaction force, during excavation work of the shovel.

2. The shovel as claimed in claim 1, further comprising:

a position detection part configured to detect a position of the shovel, wherein the controller is configured to control the pressure of the hydraulic cylinder during the excavation work of the shovel in consideration of information on the position of the shovel during the excavation work of the shovel.

3. The shovel as claimed in claim 2, wherein the controller is configured to use, as the information on the position of the shovel, at least one of information on an angle of the excavation attachment, information on an angle of inclination of the shovel, and information on a turning angle of the upper-part turning body relative to the lower-part traveling body.

4. The shovel as claimed in claim 1, wherein the controller is configured to control the pressure of the hydraulic cylinder to prevent the pressure of the hydraulic cylinder from exceeding a predetermined value that varies in accordance with information on a position of the shovel.

5. The shovel as claimed in claim 4, wherein the controller is configured to use, as the information on the position of the shovel, at least one of information on an angle of the excavation attachment, information on an angle of inclination of the shovel, and information on a turning angle of the upper-part turning body relative to the lower-part traveling body.

6. The shovel as claimed in claim 1, wherein the excavation attachment includes a boom, an arm, and a bucket, and the controller is configured to control the pressure of the hydraulic cylinder to prevent the pressure of the hydraulic cylinder during excavation work with the bucket from exceeding a predetermined value, based on information on a turning angle of the upper-part turning body, information on an angle of the boom, information on an angle of the arm, information on an angle of the bucket, and information on an angle of inclination of the shovel.

7. The shovel as claimed in claim 1, wherein the controller is configured to control the pressure of the hydraulic cylinder in response to an operation apparatus of the excavation attachment being operated.

8. The shovel as claimed in claim 1, wherein the hydraulic cylinder includes a plurality of hydraulic cylinders, and the controller is configured to control pressures of the plurality of hydraulic cylinders.

9. The shovel as claimed in claim 1, wherein the controller is configured to indicate that an operation to prevent the shovel from being dragged has been performed.

10. The shovel as claimed in claim 1, wherein the controller is configured to control the pressure of the hydraulic cylinder before the shovel is dragged to prevent the shovel from being dragged.

11. The shovel as claimed in claim 1, wherein the controller is configured to control the pressure of the hydraulic cylinder to prevent the body of the shovel from being dragged by an excavation reaction force toward an excavation point during excavation work of the shovel.

* * * * *